US006263974B1

(12) United States Patent
Sundholm

(10) Patent No.: US 6,263,974 B1
(45) Date of Patent: Jul. 24, 2001

(54) POWER SOURCE FOR SUPPLYING WATER-BASED LIQUID TO SYSTEM, AND FIRE EXTINGUISHING ARRANGEMENT

(76) Inventor: Göran Sundholm, Ilmari Kiannon kuja 3, FIN-04310 Tuusula (FI)

( * ) Notice: Subject to any disclaimer, the term of this patent is extended or adjusted under 35 U.S.C. 154(b) by 0 days.

(21) Appl. No.: 09/535,389

(22) Filed: Mar. 24, 2000

(30) Foreign Application Priority Data

Oct. 29, 1999 (FI) ..... 19992345

(51) Int. Cl.[7] ..... A62C 3/07

(52) U.S. Cl. ..... 169/62; 169/13; 169/16; 169/56; 169/54; 239/207; 239/208; 239/303; 239/565; 239/DIG. 15; 137/266; 137/347; 137/565.33; 137/899

(58) Field of Search ..... 169/5, 13, 16, 169/54, 56, 62; 137/266, 347, 565.33, 899; 239/67, 71, 207, 208, 209, 303, 304, 305, 565, DIG. 15, 548

(56) References Cited

U.S. PATENT DOCUMENTS

| | | | | |
|---|---|---|---|---|
| 3,674,215 | * | 7/1972 | Erdmann | 239/548 |
| 3,702,636 | * | 11/1972 | Hart | 169/16 X |
| 3,929,154 | * | 12/1975 | Goodwin | 137/899 X |
| 4,286,617 | * | 9/1981 | Bedient | 137/899 X |
| 4,298,021 | * | 11/1981 | Bozeman | 137/899 X |
| 4,326,589 | | 4/1982 | Ballman | 169/6 |
| 4,333,607 | * | 6/1982 | Mueller et al. | 239/13 |
| 4,361,189 | * | 11/1982 | Adams | 169/62 X |
| 4,531,538 | * | 7/1985 | Sandt et al. | 137/899 X |
| 5,240,179 | * | 8/1993 | Drinkwater | 137/59 X |
| 5,318,059 | * | 6/1994 | Lyons | 137/62 |
| 5,676,182 | * | 10/1997 | McMullen, Jr. et al. | 137/899 X |
| 5,680,329 | * | 10/1997 | Lloyd et al. | 239/71 X |
| 5,746,240 | * | 5/1998 | Ayotte et al. | 137/899 X |

FOREIGN PATENT DOCUMENTS

| | | |
|---|---|---|
| 0650743 | 5/1995 | (EP) . |
| 2769508 | 4/1999 | (FR) . |
| 2139495 | 11/1984 | (GB) . |
| 2215204 | 9/1989 | (GB) . |

* cited by examiner

*Primary Examiner*—David A. Scherbel
*Assistant Examiner*—Steven J. Gahey
(74) *Attorney, Agent, or Firm*—Ladas & Parry

(57) ABSTRACT

The invention relates to a power source for supplying water-based liquid to a system, the power source comprising a container (5) for the water-based liquid and a pump unit (6) which comprises a pump (7) and a power source (8) for the pump, the pump unit being arranged to supply the water-based liquid from the container to the system via a pipe system (4) which is filled with a liquid. To enable economical supply of water-based liquid to a system without the risk of the liquid freezing, the pipe system (4) is filled with antifreeze and the power source comprises an additional container (9) which is filled with antifreeze and an additional pump unit (10) with a pump (11) and a power unit (12) for the pump, the additional pump unit being arranged to maintain a stand-by pressure in the pipe system via a pipeline (13) and to supply for this purpose antifreeze from the additional container to the pipe system (4) if the pressure in the pipeline drops below the stand-by pressure, whereby the pump unit (6) for pumping water-based liquid is arranged to feed water-based liquid which has a tendency to freeze into and out of the pipe system in liquid phase if the pressure in the pipe system drops below a certain level.

18 Claims, 1 Drawing Sheet

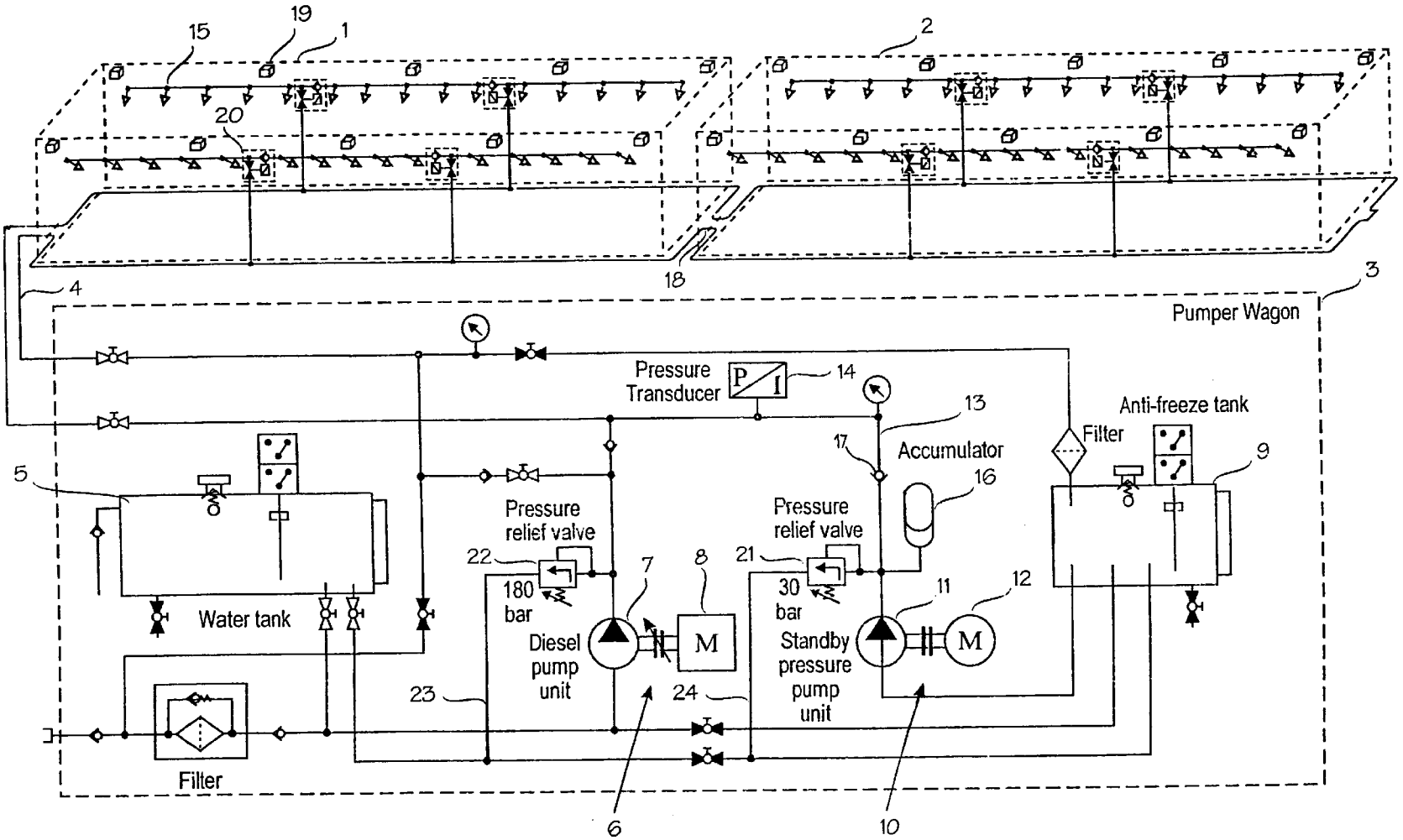
Pumper Wagon
Anti-freeze tank
Filter
Accumulator
Pressure relief valve
30 bar
Standby pressure pump unit
Pressure Transducer
Pressure relief valve
180 bar
Diesel pump unit
Water tank
Filter
1
2
3
4
5
6
7
8
9
10
11
12
13
14
15
16
17
18
19
20
21
22
23
24

POWER SOURCE FOR SUPPLYING WATER-BASED LIQUID TO SYSTEM, AND FIRE EXTINGUISHING ARRANGEMENT

BACKGROUND OF THE INVENTION

The invention relates to a power source for supplying water-based liquid to a system, the power source comprising a container for the water-based liquid and a pump unit which consists of a pump and a power source for the pump and is arranged to supply the water-based liquid from the container to the system via a pipe system filled with a liquid.

Here the term 'water-based liquid' means pure water or different water-containing additives, depending on the purpose for which the liquid is used.

Such a power source is particularly commonly used in various systems, e.g. in houses, for supplying water from a fresh water source, such as a well, to the pipe system of the house. Another application for a power source of this kind is a fire extinguishing installation.

The present invention also relates to a fire extinguishing installation, and particularly to a fire extinguishing installation comprising a spray head and a power source for supplying water-based liquid to a unit which is to be protected against fire, the power source comprising a container for the water-based liquid and a pump unit which comprises a pump and a power source for the pump and is arranged to supply the water-based liquid from the container to the unit via a pipe system filled with a liquid.

Certain environments where water or water-based liquid is to be supplied involve a risk of freezing. This problem is common in various situations in countries where the temperature drops below the freezing point of water. Some applications are related to a system without recirculation, i.e. a system where the amount of liquid decreases as it is used for a specific purpose. An example of the last-mentioned is a fire extinguishing installation which uses water-based liquid as extinguishant. In these it is particularly important that the extinguishant does not freeze because in that case the installation cannot work.

In several applications the problem of freezing is solved by mixing a substance which prevents freezing into water. However, the substances which prevent freezing, or antifreezes, are expensive; in fact much more expensive than water or water-based liquid. The larger the system and the liquid volume, the more expensive addition of antifreeze is. Because of this, the use of antifreezes in power sources with large containers involves the problem of high costs.

An example of applications where the above-mentioned problems occur is a fire extinguishing installation which is dimensioned for larger fires and in which the consumption of extinguishant is high. Furthermore, if antifreeze is mixed into water or water-based liquid in a fire extinguishing installation which uses water-based liquid, the resulting extinguishant will have a poorer extinguishing capability than a liquid into which antifreeze has not been mixed. Thus the use of antifreezes leads to a further problem of poor function.

To avoid high costs, substances which prevent the risk of freezing are sometimes omitted from the water-based liquid, which can have serious consequences in fire extinguishing installations, for example. The water-based liquid may also be replaced with a fluid which is harmful to the environment. Furthermore, in some cases the amount of water can be reduced, but in fire extinguishing installations, for example, this naturally involves a risk.

BRIEF DESCRIPTION OF THE INVENTION

An object of the present invention is to provide a power source for supplying water-based liquid which enables supply of water-based liquid to the system without the risk of freezing and by using only a small amount of expensive substances which prevent freezing of water.

To achieve this object, the present invention provides a power source wherein the pipe system is filled with antifreeze and the power source comprises an additional container filled with antifreeze and an additional pump unit with a pump and a power unit for the pump, the additional pump unit being arranged to maintain a stand-by pressure in the pipe system via a pipeline and to supply for this purpose antifreeze from the additional container to the pipe system if the pressure in the pipeline drops below the stand-by pressure, whereby the pump unit for pumping water-based liquid is arranged to feed water-based liquid which has a tendency to freeze into and out of the pipe system in liquid phase.

Since antifreeze is needed only in those sections of the system which may be exposed to frost, the volume of the additional container can be several times smaller than that of the container where water-based liquid is used. Naturally this requires that the container filled with water-based liquid has to be situated in a place where the water-based liquid cannot freeze.

The preferred embodiments of the power source are disclosed in appended claims 2 to 10.

The major advantage of the power source is that it allows to minimize the use of expensive substances which prevent freezing of water, which is particularly significant when the container is large, i.e. in connection with a system which uses large amounts of liquid which should not freeze.

The present invention provides a fire extinguishing installation wherein the pipe system is filled with antifreeze and the power source comprises an additional container filled with antifreeze, and an additional pump unit with a pump and a power unit for the pump, the additional pump unit being arranged to maintain a stand-by pressure in the pipe system via a pipeline and to supply for this purpose antifreeze from the additional container to the pipe system if the pressure in the pipeline drops below the stand-by pressure, whereby the pump unit for pumping water-based liquid is arranged to feed water-based liquid which has a tendency to freeze into and out of the pipe system in liquid phase.

A basic idea of the invention is that a liquid with the risk of freezing is replaced with antifreeze only when it is necessary, i.e. in environments where there is time for the liquid with the risk of freezing to freeze and in which liquid with the risk of freezing can be used for a short period, i.e. when there is no time for the liquid with the risk of freezing to freeze.

The fire extinguishing installation is particularly suitable for trains. This application allows to lower the costs of the extinguishant considerably.

The preferred embodiments of the fire extinguishing installation are disclosed in appended claims 12 to 14.

The major advantage of the fire extinguishing installation is that the costs of the extinguishant can be kept low, especially in applications where the amount of extinguishant should be large. At the same time, the extinguishant has a good extinguishing capability and cannot practically freeze.

BRIEF DESCRIPTION OF THE DRAWINGS

In the following, the invention will be described in greater detail by means of an example with reference to the attached FIGURE which shows a fire extinguishing installation in a railway carriage and the power source for the fire extinguishing installation.

DETAILED DESCRIPTION OF THE INVENTION

The FIGURE shows a system which comprises three railway carriages 1, 2, 3 of a train. One carriage 3 of the railway carriages comprises a power source with pump units 6, 10. The last-mentioned railway carriage 3 could be called a pump carriage. The train is provided with a fire extinguishing installation which comprises the above-mentioned power source and several spray heads 15. The power source is arranged to supply extinguishant in the form of water-based liquid to the spray heads 15 via a pipe system 4. The railway carriages 1, 2 are provided with detectors 19 and section valves 20 by means of which the desired groups of spray heads can be released in the event of fire. Alternatively, all spray heads 15 in a railway carriage can be arranged to be released when a fire is detected in the carriage concerned. The spray heads 15 can also be arranged to be released separately, in which case they typically comprise heat-activated release devices and are released when their release device explodes or melts in the heat.

The power source comprises a large container 5 filled with water-based liquid. Since the container 5 is in the pump carriage which functions as a space which is heat-insulated against the environment, there is no risk of the liquid freezing which could otherwise be possible in the environment of the fire extinguishing installation. The container 5 has a large volume, e.g. 20–30000 I. A pump unit 6 is arranged to feed water-based liquid from the container 5 to the pipe system 4 via a pipe, the unit comprising a high-pressure pump 7 which can generate a pressure of e.g. 50 to 200 bar and a diesel engine 8 with an output of e.g. 200 kW as a power source for the pump.

The power source comprises an additional container 9 which is filled with antifreeze. A pump unit 10 which comprises a pump 11 and an electric motor 12 as the power source for the pump is arranged to feed antifreeze from the container 9 to the pipe system 4 via a pipeline 13. There is a pressure indicator 14 and an accumulator 16 connected to the pipeline 13.

A valve 17 is attached to the pipeline 13. The valve, when closed, prevents liquid from flowing back to the container 9.

In the following, it will be explained how the system shown in the FIGURE functions.

In the example, the pipe system 4 is filled with antifreeze. Thus the pipe system 4 can be placed in an environment where the temperature drops below the freezing point of water without the liquid freezing in the pipe. In the pipe system 4 there is a stand-by pressure of e.g. 10 to 30 bar before the spray heads 15 start to function. Since the pipe system 4 typically continues from one carriage to several other carriages, there has to be couplings 18 between the carriages which can be locked and unlocked as railway carriages are attached to and detached from the train.

In practice, the pressure changes in the pipe system 4 although no spray head 15 is released. To make sure that the pipe system 4 is always filled with liquid and to level the pressure changes, the pump unit 10 is arranged to maintain the above-mentioned stand-by pressure in the pipe system. The pressure indicator 14 controls the stand-by pressure so that it starts the motor 12 if the pressure drops below a certain value, e.g. 20 bar. If the pressure rises over a certain higher value, e.g. 30 bar, because the pump unit has raised the pressure, the pressure indicator makes the motor 12 stop. So that the motor 12 would not be switched on and off several times at short intervals, the accumulator 16 is arranged to supply antifreeze to the pipeline 13 and pipe system 4. Thus the accumulator 16 functions as a buffer.

If a spray head 15 of the fire extinguishing installation starts to spray liquid as a result of the fact that a detector 19 has reacted to a fire and given a signal to open a section valve 20, the pressure in the pipe system 4 drops. When the pressure has dropped below e.g. 5 bar, the pressure indicator 14 reacts to the pressure drop and gives a signal to the diesel engine 8 so that it starts, in which case the pump 7 starts to pump water-based liquid into the pipe system 4 at high pressure. The pressure is preferably in a range of 50 to 200 bar, for instance. Since the temperature of the water-based liquid is relatively high and it is carried in the pipe system at a relatively high rate, the temperature of the liquid does not have time to drop so much that the liquid would freeze. Consequently, the liquid flows out of the spray heads 15.

The pressure indicator thus controls the power sources of both pump units, i.e. the electric motor 12 and the diesel engine 8. Instead of a pressure indicator 14, it is possible to use a number of pressure switches which give signals to the pump units when the pressure drops below a certain level or exceeds it.

Since antifreeze is only needed to compensate for a possible leakage in the pipe system 4 before the fire extinguishing installation starts to spray extinguishant, the volume of the container 9 can be several times smaller than the volume of the large container 5. The volume of the container 9 could be e.g. 100 I.

Reference number 21 denotes a shut-off valve which prevents the pump unit 10 from feeding antifreeze into the pipe system 4 at too high a pressure, which may be generated if the pressure indicator 14 does not function properly and which could damage a component of the power source. If a pressure higher than 30 bar is generated, it is led back to the container 9 via a pipe 24. The shut-off valve 21 functions as a safety valve.

Reference number 22 denotes a shut-off valve which prevents the pump unit 6 from feeding water-based liquid into the pipe system 4 at high pressure, e.g. over 200 bar, if the pressure indicator 14 does not function properly. Such a pressure is led back to the container 5 via a pipe 23. The shut-off valve 22 has the same function as the shut-off valve 21, and thus it can also be called a safety valve.

In the above, the invention has been described only by means of one example. Therefore it is emphasized that the details of the invention may vary in several ways within the scope of the appended claims. The structure of the pump units, for example, may vary. The engine 8 could be an electric motor and the motor 12 a diesel engine. The containers 5, 9 may differ from what has been described above; however, the basic idea does not change, i.e. the container 5 is considerably larger than the container 9 as well as very large in absolute terms, typically thousands of liters. The system can be used in a place other than a railway carriage, and it does not need to comprise a fire extinguishing installation, although the invention is particularly suitable for fire extinguishing installations. The antifreeze, which in the example is in the pipe system, is preferably, but not necessarily, the same antifreeze as that used in the additional container 9.

What is claimed is:

1. A power source for supplying water-based liquid, the power source comprising:

a container for water-based liquid;

a pump unit comprising a pump and a power source for the pump, the pump unit being arranged to supply the water-based liquid from the container to a pipe system that is filled with antifreeze;

an additional container filled with antifreeze;

an additional pump unit comprising another pump and another power source for the other pump, the additional pump unit being arranged to maintain a stand-by pressure in the pipe system and to supply for this purpose the antifreeze from the additional container to the pipe system if the pressure in the pipe system drops below the standy-by pressure; and means for arranging the pump unit for the supply of the water-based liquid into and out of the pipe system in liquid phase in response to a further pressure drop in the pipe system.

2. A power source according to claim 1, wherein the volume of the additional container is several times smaller than the volume of the container.

3. A power source according to claim 1, wherein the power source for the additional pump unit comprises an electric motor.

4. A power source according to claim 1, wherein an accumulator is connected to a pipeline to the system, the accumulator being arranged to compensate for pressure differences in the system.

5. A power source according to claim 1, wherein the pump of the pump unit is a high-pressure pump.

6. A power source according to claim 5, wherein the pump unit is arranged to provide the system with a pressure of 50 to 200 bar.

7. A power source according to claim 1, wherein the power source for the pump unit is a diesel engine.

8. A power source according to claim 1, wherein the means for arranging the pump unit for the supply of the water-based liquid into and out of the pipe system comprises a pressure indicator to start the pump unit in response to the further pressure drop.

9. A power source according to claim 1, wherein the stand-by pressure is 10 to 30 bar.

10. A power source according to claim 1, wherein the container filled with water-based liquid is in a heat-insulated space.

11. A fire extinguishing installation comprising:

a spray head and a power source for supplying water-based liquid to the spray head, the power source comprising a container for the water-based liquid and a pump unit which comprises a pump and a power source for the pump, the pump unit being arranged to supply the water-based liquid from the container to the spray head via a pipe system filled with antifreeze;

an additional container which is filled with antifreeze;

an additional pump unit with another pump and another power source for the other pump, the additional pump unit being arranged to maintain a stand-by pressure in the pipe system and to supply for this purpose the antifreeze from the additional container to the pipe system if the pressure in the pipe system drops below the stand-by pressure; and means for arranging the pump unit for the supply of the water-based liquid into and out of the pipe system in liquid phase in response to a further pressure drop in the pipe system.

12. A fire extinguishing installation according to claim 11, wherein the installation is on a train and the container is in a heat-insulated space of a railway carriage.

13. A fire extinguishing installation according to claim 12, wherein the power source is placed in the railway carriage.

14. A fire extinguishing installation according to claim 13, wherein the means for arranging comprises a pressure indicator adapted to start the pump unit in response to the further pressure drop.

15. A fire extinguishing installation according to claim 12, wherein the means for arranging comprises a pressure indicator adapted to start the pump unit in response to the further pressure drop.

16. A fire extinguishing installation according to claim 11, wherein the volume of the additional container is several times smaller than the volume of the container.

17. A fire extinguishing installation according to claim 16, wherein the means for arranging comprises a pressure indicator adapted to start the pump unit in response to the further pressure drop.

18. A fire extinguishing installation according to claim 11, wherein the means for arranging comprises a pressure indicator adapted to start the pump unit in response to the further pressure drop.

* * * * *